US012317946B2

(12) United States Patent
Infusino et al.

(10) Patent No.: US 12,317,946 B2
(45) Date of Patent: Jun. 3, 2025

(54) PROTECTIVE SPORTS HELMET CHINSTRAP ASSEMBLY

(71) Applicant: Riddell, Inc., Des Plaines, IL (US)

(72) Inventors: Ralph Infusino, Bloomingdale, IL (US); Nelson Kraemer, Mount Prospect, IL (US); Vittorio Bologna, Elk Grove, IL (US)

(73) Assignee: Riddell, Inc., Des Plaines, IL (US)

( * ) Notice: Subject to any disclaimer, the term of this patent is extended or adjusted under 35 U.S.C. 154(b) by 589 days.

(21) Appl. No.: 17/521,244

(22) Filed: Nov. 8, 2021

(65) Prior Publication Data

US 2022/0053867 A1 Feb. 24, 2022

Related U.S. Application Data

(63) Continuation of application No. 15/699,661, filed on Sep. 8, 2017, now Pat. No. 11,166,511, which is a continuation of application No. 14/021,899, filed on Sep. 9, 2013, now Pat. No. 9,756,889.

(60) Provisional application No. 61/698,987, filed on Sep. 10, 2012.

(51) Int. Cl.
*A42B 3/08* (2006.01)

(52) U.S. Cl.
CPC ..... *A42B 3/08* (2013.01)

(58) Field of Classification Search
CPC ..... A42B 3/08
USPC ..... 2/421
See application file for complete search history.

(56) References Cited

U.S. PATENT DOCUMENTS

| | | | |
|---|---|---|---|
| 1,060,220 | A | 4/1913 | White |
| 1,262,818 | A | 4/1918 | McGill |
| 2,140,716 | A | 12/1938 | Pryale |
| 2,250,275 | A | 7/1941 | Riddell |
| 2,354,840 | A | 8/1944 | Seletz |
| 2,777,127 | A | 1/1957 | Marietta |
| 2,867,811 | A | 1/1959 | Jones |
| 2,867,812 | A | 1/1959 | Roth |
| 3,106,716 | A | 10/1963 | Beebe |
| 3,113,362 | A | 12/1963 | Tonino |
| 3,166,761 | A | 1/1965 | Strohm |
| 3,186,004 | A | 6/1965 | Carlini |
| 3,187,342 | A | 6/1965 | Aileo |
| 3,189,917 | A | 6/1965 | Sims |
| 3,216,023 | A | 11/1965 | Morgan |
| 3,267,545 | A | 8/1966 | Eckart |
| 3,274,613 | A | 9/1966 | Sowle |

(Continued)

FOREIGN PATENT DOCUMENTS

GB 1354719 6/1974

OTHER PUBLICATIONS

Riddell 2008, Multi-Sport catalog, including cover page and football chin straps (p. 14).

(Continued)

*Primary Examiner* — Alissa J Tompkins
*Assistant Examiner* — Catherine M Ferreira
(74) *Attorney, Agent, or Firm* — Barnes & Thornburg LLP

(57) ABSTRACT

A chin strap assembly is provided for use with a sports helmet. The chin strap assembly includes an inner pad member, a strap assembly and an outer protective member. The outer protective member is coupled to the strap assembly by an attachment member, such as a post. A sports helmet with the chin strap assembly is also provided.

29 Claims, 10 Drawing Sheets

(56) References Cited

U.S. PATENT DOCUMENTS

| | | | | |
|---|---|---|---|---|
| 3,327,316 | A | 6/1967 | Pukish | |
| 3,418,657 | A | 12/1968 | Lastnik | |
| 3,423,832 | A | 1/1969 | Nelson | |
| 3,462,763 | A | 8/1969 | Schneider | |
| 3,478,365 | A | 11/1969 | Varga | |
| 3,619,813 | A | 11/1971 | Marchello | |
| 3,729,744 | A | 5/1973 | Rappleyea | |
| 3,761,959 | A | 10/1973 | Dunning | |
| 3,787,895 | A | 1/1974 | Belvedere | |
| 3,815,152 | A | 6/1974 | Bednarczuk | |
| 3,818,508 | A | 6/1974 | Lammers | |
| 3,916,446 | A | 11/1975 | Gooding | |
| 3,994,020 | A | 11/1976 | Villari | |
| 4,044,400 | A | 8/1977 | Lewicki | |
| 4,075,714 | A | 2/1978 | Ryder | |
| 4,398,306 | A | 8/1983 | Gooding | |
| 4,461,044 | A | 7/1984 | Reiterman | |
| 4,577,375 | A | 3/1986 | Beaussant | |
| 4,641,382 | A | 2/1987 | Gessalin | |
| 4,646,368 | A | 3/1987 | Infusino | |
| 4,646,401 | A | 3/1987 | Morell | |
| 4,651,356 | A | 3/1987 | Zide | |
| 4,665,748 | A | 5/1987 | Peters | |
| 4,692,947 | A | 9/1987 | Black | |
| 4,727,630 | A | 3/1988 | Wan | |
| 4,733,440 | A | 3/1988 | Ogawa | |
| D295,800 | S | 5/1988 | Shelton, Jr. | |
| 4,741,054 | A | 5/1988 | Mattes | |
| 4,853,980 | A | 8/1989 | Zarotti | |
| 4,903,381 | A | 2/1990 | Fohl | |
| 4,999,846 | A | 3/1991 | Ball | |
| 5,101,580 | A | 4/1992 | Lyden | |
| D332,507 | S | 1/1993 | Anderson | |
| 5,177,816 | A | 1/1993 | Schmidt | |
| 5,184,352 | A | 2/1993 | Maufette | |
| 5,267,679 | A | 12/1993 | Kamaya | |
| 5,347,660 | A | 9/1994 | Zide | |
| 5,461,730 | A | 10/1995 | Carrington | |
| 5,483,699 | A | 1/1996 | Pernicka | |
| 5,572,771 | A | 11/1996 | Kelleghan | |
| 5,579,563 | A | 12/1996 | Sim | |
| 5,588,186 | A | 12/1996 | Ko | |
| D378,236 | S | 2/1997 | Zanotto | |
| 5,688,229 | A | 11/1997 | Bauer | |
| 5,732,414 | A | 3/1998 | Monica | |
| 5,774,953 | A | 7/1998 | Mao | |
| 5,794,274 | A | 8/1998 | Kraemer | |
| 5,799,337 | A | 9/1998 | Brown | |
| 5,913,412 | A | 6/1999 | Huber | |
| 5,946,735 | A | 9/1999 | Bayes | |
| 6,081,932 | A | 7/2000 | Kraemer | |
| 6,189,156 | B1 | 2/2001 | Loiars | |
| 6,256,798 | B1 | 7/2001 | Egolf | |
| 6,298,483 | B1 * | 10/2001 | Schiebl | A42B 3/08 2/9 |
| 6,324,701 | B1 | 12/2001 | Alexander | |
| 6,341,382 | B1 | 1/2002 | Ryvin | |
| 6,457,210 | B1 | 10/2002 | Shirai | |
| 6,481,024 | B1 * | 11/2002 | Grant | A42B 3/08 2/9 |
| 6,499,139 | B1 | 12/2002 | Brown | |
| 6,568,505 | B1 | 5/2003 | Dacquisto | |
| 6,691,378 | B1 | 2/2004 | Chou | |
| 6,715,449 | B1 | 4/2004 | Jordan | |
| 6,772,447 | B2 | 8/2004 | Morrow | |
| 6,934,971 | B2 | 8/2005 | Ide | |
| D512,534 | S | 12/2005 | Maddux | |
| D526,746 | S | 8/2006 | Wong | |
| 7,162,778 | B2 | 1/2007 | Pan | |
| 7,240,376 | B2 | 7/2007 | Ide | |
| 7,246,383 | B2 | 7/2007 | Musal | |
| 7,296,305 | B2 | 11/2007 | Ketterer | |
| 7,735,160 | B1 | 6/2010 | Schiebl | |
| 7,870,617 | B2 | 1/2011 | Butler | |
| 7,886,370 | B2 * | 2/2011 | Winningham | A63B 71/10 2/9 |
| 7,900,279 | B2 | 3/2011 | Kraemer | |
| 7,921,475 | B2 | 4/2011 | Nascimento | |
| 7,954,177 | B2 | 6/2011 | Ide | |
| 8,006,322 | B1 * | 8/2011 | Schiebl | A42B 3/205 2/421 |
| 8,056,151 | B2 | 11/2011 | Bologna | |
| 8,453,269 | B2 | 6/2013 | Hampton, II | |
| 8,528,118 | B2 | 9/2013 | Ide | |
| D695,468 | S | 12/2013 | Finlan | |
| 8,621,671 | B1 | 1/2014 | Schiebl | |
| 8,650,665 | B2 | 2/2014 | Shirai | |
| D715,005 | S | 10/2014 | Schiebl | |
| 8,938,818 | B2 | 1/2015 | Ide | |
| 8,955,200 | B2 | 2/2015 | Ng | |
| 9,068,674 | B1 | 6/2015 | Mangone | |
| 9,314,060 | B2 | 4/2016 | Giles | |
| 9,622,532 | B2 | 4/2017 | Tryner | |
| 9,756,889 | B2 | 9/2017 | Infusino | |
| 9,763,488 | B2 | 9/2017 | Bologna | |
| 9,788,591 | B2 | 10/2017 | Ide | |
| 9,867,415 | B2 | 1/2018 | Gowen | |
| 10,136,692 | B2 | 11/2018 | Ide | |
| 2002/0104533 | A1 | 8/2002 | Kalhok | |
| 2004/0098793 | A1 | 5/2004 | Gershenson | |
| 2005/0273911 | A1 | 12/2005 | Skiba | |
| 2006/0117466 | A1 | 6/2006 | Abelman | |
| 2006/0150304 | A1 | 7/2006 | Bentz | |
| 2008/0028500 | A1 | 2/2008 | Bentz | |
| 2008/0092277 | A1 | 4/2008 | Kraemer | |
| 2009/0038055 | A1 | 2/2009 | Ferrara | |
| 2009/0265841 | A1 | 10/2009 | Ferrara | |
| 2010/0192286 | A1 | 8/2010 | Bologna | |
| 2010/0319109 | A1 | 12/2010 | Field | |
| 2010/0319701 | A1 | 12/2010 | Connell | |
| 2011/0209272 | A1 | 9/2011 | Drake | |
| 2011/0225706 | A1 | 9/2011 | Pye | |
| 2011/0271428 | A1 | 11/2011 | Withnall | |
| 2011/0277221 | A1 | 11/2011 | Christopher | |
| 2012/0124721 | A1 | 5/2012 | Hampton | |
| 2013/0074248 | A1 | 3/2013 | Evans | |
| 2014/0068844 | A1 | 3/2014 | Infusino | |
| 2014/0150169 | A1 | 6/2014 | Infusino | |
| 2015/0013122 | A1 | 1/2015 | Mitchell, Jr. | |
| 2018/0084859 | A1 | 3/2018 | Bancroft | |

OTHER PUBLICATIONS

Athletic Journal Catalog Excerpt, vol. 41, No. 10, Jun. 1961 (2 pages).
Athletic Journal Catalog Excerpt, vol. 37, No. 5, Jan. 1957 (2 pages).
Athletic Journal Catalog Excerpt, vol. 41, No. 9, May 1961 (2 pages).
Athletic Journal Catalog Excerpt, vol. 48, No. 3, Nov. 1967 (2 pages).
Rawlings 1955-56 Advance Football and Basketball Catalog (36 pages).
Rawlings Advance Football and Basketball Catalog 1957 (46 pages).
Rawlings Catalog Fall and Winter Athletic Equipment 1959-1960 (84 pages).
Rawlings Catalog Fall and Winter Athletic Equipment 1963 (72 pages).
Rawlings Catalog Fall and Winter Institutional 1971 (92 pages).
Rawlings Catalog Fall and Winter Retail Sher-wood Adirondack 1975 (28 pages).
Riddell 1989 Football Air Catalog (16 pages).
Riddell 1989 Football Catalog (24 pages).
Riddell 1992 Catalog (40 pages).
Riddell 1996-1997 Football Catalog (40 pages).
Riddell 1998 Football Air Catalog (16 pages).
Riddell 1998-1999 Football Catalog (72 pages).
Riddell 2001 Football Catalog (94 pages).
Wilson Trade Price Edition Fall and Winter 1964 Catalog (152 pages).

(56) References Cited

OTHER PUBLICATIONS

Schutt 2001 Football Catalog (46 pages).
Medalist Gladiator 1989 Fall and Winter Catalog (20 pages).
Scholastic Coach, MacGregor E700 Helmet, Jan. 1959 (2 pages).
Sports Review Football 1954, Rawlings HC20 and TH24 Helmet (2 page).
Sears Wish Book for the 1971 Christmas Season Catalog (11 pages).
GB Lax Gait Brothers Lacrosse Magazine 2002 (24 pages).
Sears Fall and Winter Catalog 1966 (2 pages).
Hutch Catalog 1976 (40 pages).
Bike Football Catalog 2002 (2 pages).
David Bushing, Sports Equipment Price Guide (1995), pp. 236-238, 240-241, 243-244, 263.
Riddell 2004 Football Catalog (88 pages).
Riddell 2005 Catalog (164 pages).
Riddell 2009 Football Catalog (132 pages).
Schutt 2009 Football Quick Guide (12 pages).
Scholastic Coach, Spalding Helmet, Mar. 1959 (2 pages).
John Field, Patton of the Armored Force, LIFE Magazine, Nov. 30, 1942 (4 pages).
Athletic Journal Catalog Excerpt, vol. 47, No. 3, Nov. 1966 (2 pages).
Athletic Journal Catalog Excerpt, MacGregor E700 Helmet, Jan. 1959 (1 page).
"Rail." Merriam-Webster.com. Accessed May 5, 2016. http://www.merriam-webster.com/dictionary/rail.

* cited by examiner

PROTECTIVE SPORTS HELMET CHINSTRAP ASSEMBLY

CROSS-REFERENCE TO RELATED APPLICATIONS

This Application is a continuation of pending U.S. patent application Ser. No. 15/699,661, filed on Sep. 8, 2017, which is a continuation of U.S. Pat. No. 9,756,889, issued on Sep. 12, 2017, which claims the benefit of priority under 35 U.S.C. § 119 from U.S. Provisional Patent Application Ser. No. 61/698,987, filed on Sep. 10, 2012, the disclosures of which are hereby incorporated by reference in their entirety for all purposes.

TECHNICAL FIELD

The invention relates to a chinstrap assembly for securing a helmet to the head of a player engaged in a contact sport, such as football, lacrosse or hockey. The chinstrap assembly includes a flexible inner pad member and a substantially rigid outer protective member that is removably attached to the inner pad member.

BACKGROUND OF THE INVENTION

Chinstraps are known for securing helmets to the heads of players in contact sports such as football, lacrosse or hockey. Chinstraps generally include a cup portion that overlies the wearer's chin, and straps that extend from the cup and attach to the helmet. There are generally two types of cups—a soft cup comprising an assembly of flexible fabrics such as vinyl, nylon, and the like, and a hard cup that includes a rigid outer portion and a padded inner portion rigidly attached, typically by gluing, to the rigid outer portion. An example of a hard cup chinstrap is shown in U.S. Pat. No. 6,081,932, entitled, "CHIN STRAP ASSEMBLY FOR USE WITH AN ATHLETIC HELMET."

Soft cups are often integrally formed with the straps, for example, the straps are arranged to criss-cross over the wearer's jaw bone on each side of the wearer's chin, and a web of fabric is stitched into the resulting oblong space between the straps to overlie the wearer's chin. Hard cups often include slots formed in the rigid outer portion, which is typically formed of an impact resistant plastic, and the straps extend through or otherwise coupled to the slots. As mentioned above, an inner pad member is typically glued and permanently attached to the rigid outer portion.

While soft cups can flex to accommodate the player's anatomical features to provide a more customized fit, they provide less protection for the wearer's chin compared to hard cups. A hard cup, while providing increased protection of the wearer's chin, may not fit as well as a soft cup because of the rigidity of the hard cup.

In addition to being less comfortable, a poorly fitting chinstrap assembly may also be less effective at maintaining the helmet in an appropriate location on the wearer's head, which can reduce the overall level of protection for the user. Features and advantages of the invention will be apparent to those skilled in the art upon review of the following detailed description and accompanying drawings.

DETAILED DESCRIPTION

Figure 1:
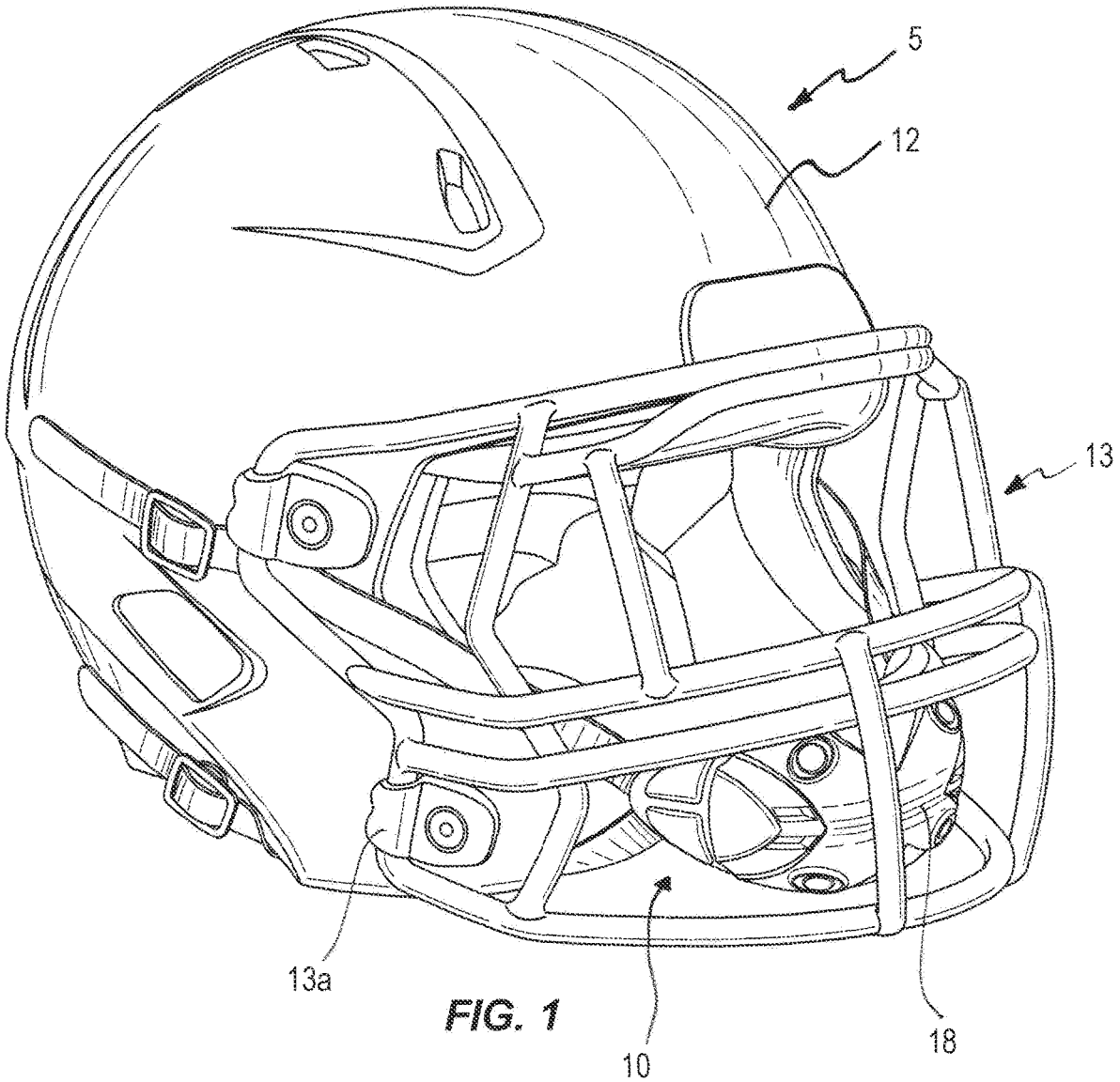
FIG. 1 is a perspective view of a protective sports helmet with a chinstrap assembly.
Figure 2:
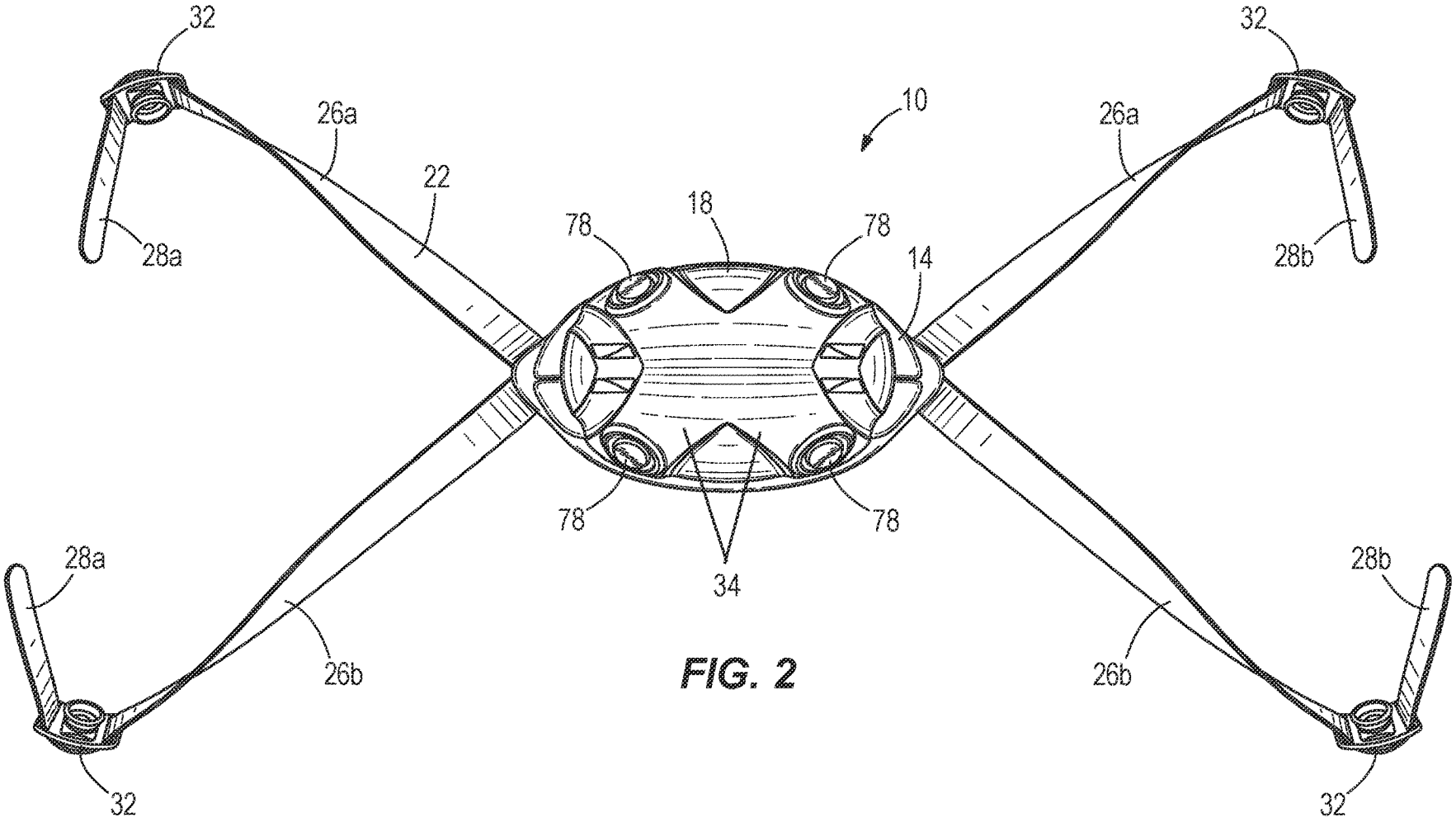
FIG. 2 is a front view of the chinstrap assembly of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIGS. 1-8 illustrate a protective sports helmet 5 and a chinstrap assembly 10 according to the invention. The sports helmet 5 includes a protective outer shell 12 and a face guard or face mask 13, which is configured to protect the facial area of the wearer of the helmet 5. The face mask 13 is coupled to the shell 12 by a plurality of connectors 13*a*. When the helmet 5 is properly positioned on the wearer's head, the chinstrap assembly 10 engages a substantial portion of the wearer's chin and is positioned generally at or below a lower portion of the face mask 13. The sports helmet 5 is shown to be a football helmet, however, the chin strap assembly 10 can be utilized with a hockey or lacrosse helmet.

The chinstrap assembly 10 includes a flexible first or inner pad member 14, a substantially rigid second or outer protective member 18, and a strap assembly 22. The strap assembly 22 extends through the inner pad member 14, and the outer protective member 18 is coupled to the strap assembly 22, as explained below. The configuration of the inner pad member 14, the outer protective member 18, and strap assembly 22 permits relative movement between the inner pad member 14 and the outer protective member 18, which can result in an improved fit for the wearer. In some embodiments, including the illustrated embodiment, the outer protective member 18 is releasably coupled to the strap assembly 22 and can therefore be removed from the strap assembly 22, generally without the use of tools. Such releasable coupling can allow a user to quickly and easily change the outer protective member 18, for example if the outer protective member 18 becomes damaged, or to change the appearance of the overall chinstrap assembly 10 by exchanging an outer protective member 18 of one color for an outer protective member 18 of a different color. In other embodiments the outer protective member 18 may be permanently coupled to the strap assembly 22.

Figure 3:
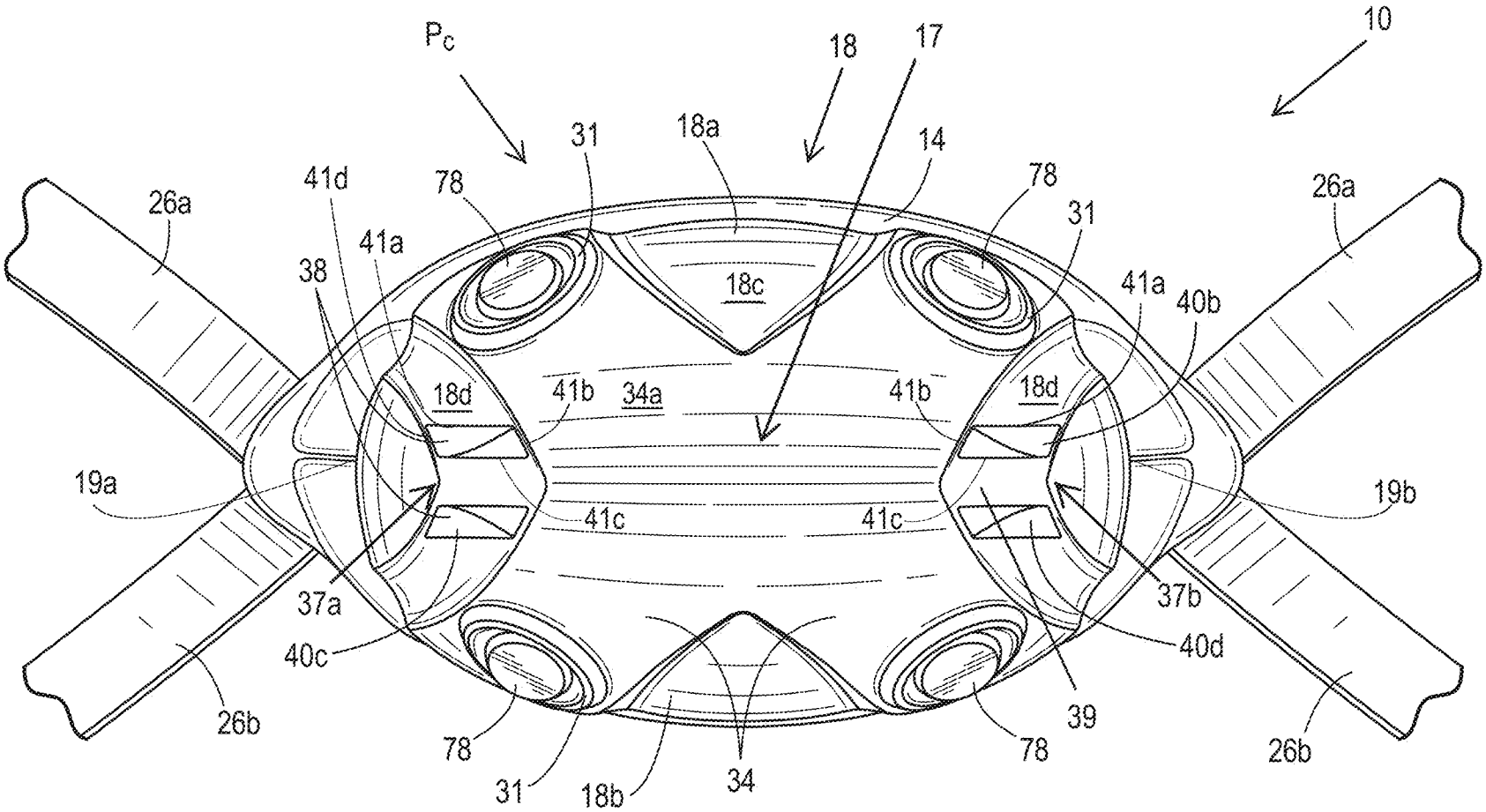
FIG. 3 is an enlarged front view of the chinstrap assembly of FIG. 1.
Figure 4:
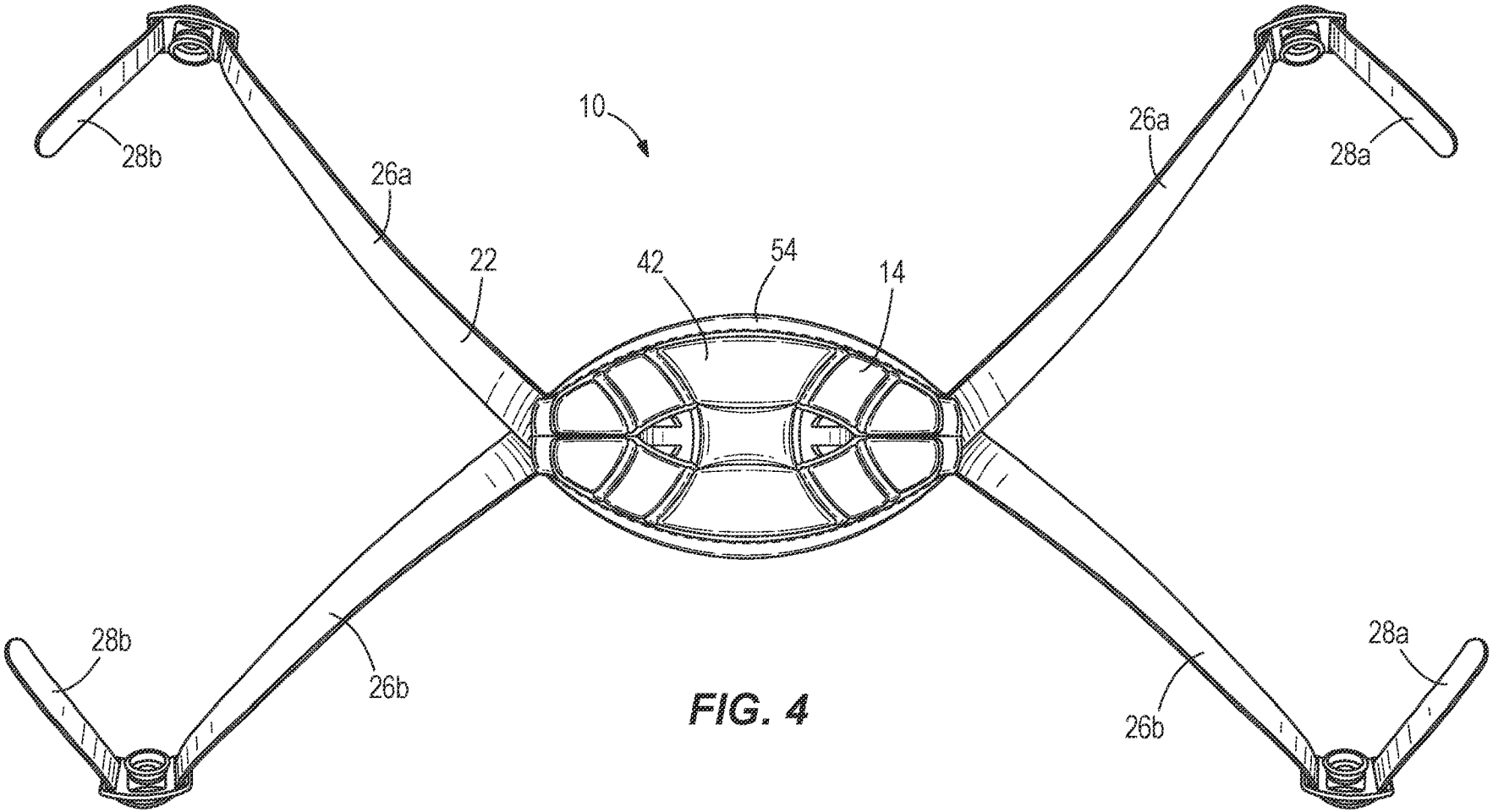
FIG. 4 is a rear view of the chinstrap assembly of FIG. 1.
Figure 5:
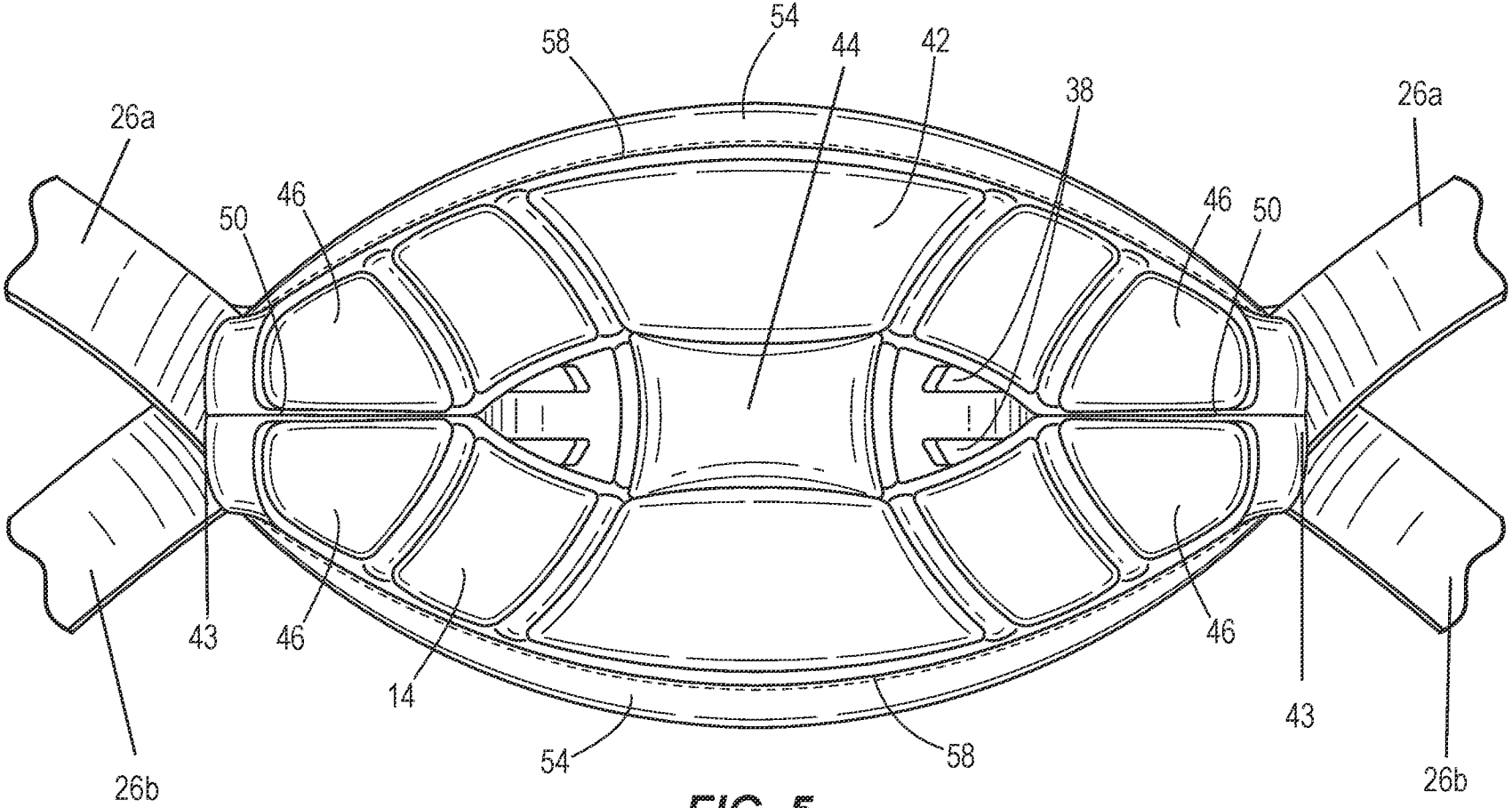
FIG. 5 is an enlarged rear view of the chinstrap assembly of FIG. 1.
Figure 6:
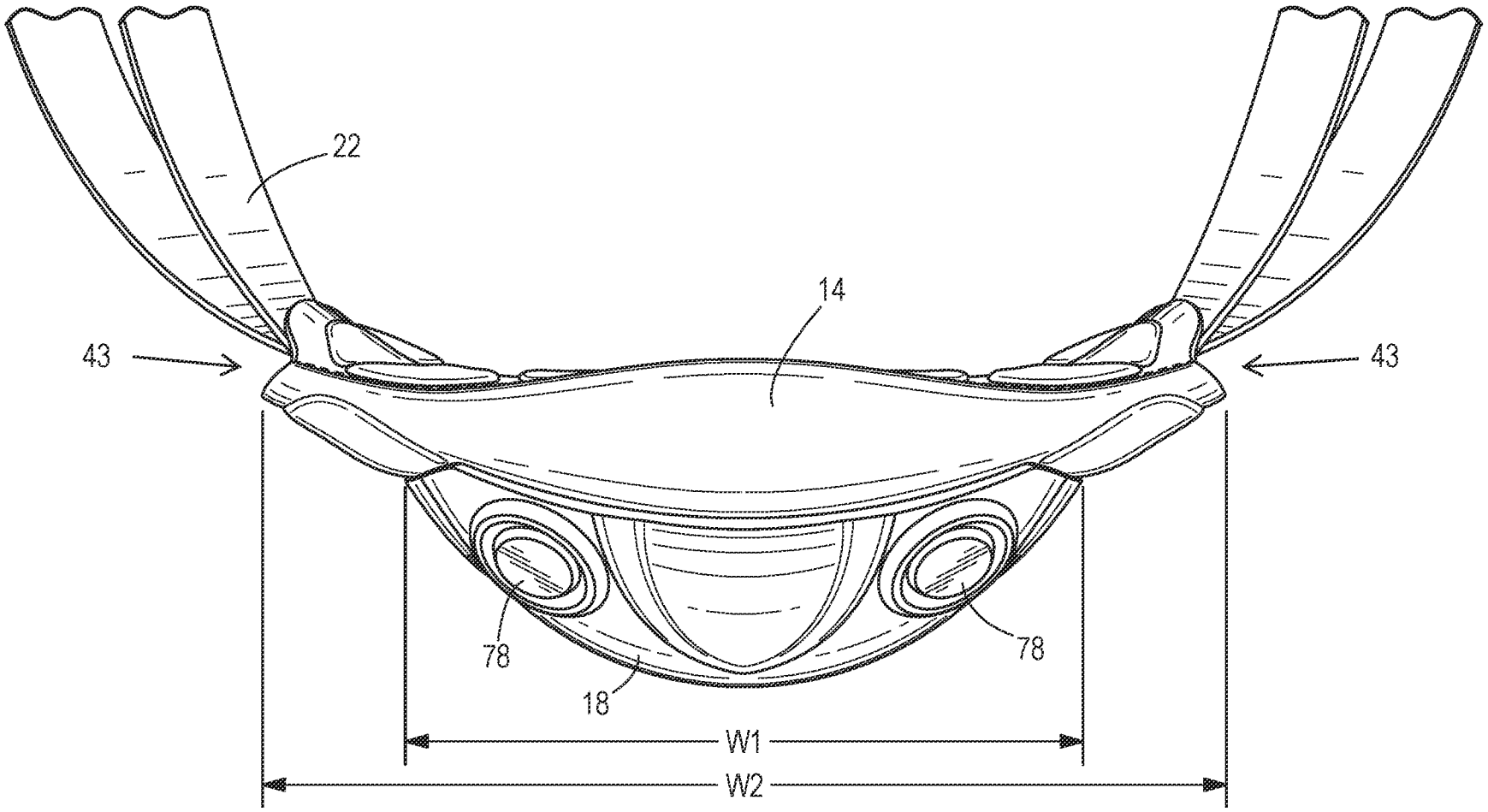
FIG. 6 is a top view of the chinstrap assembly of FIG. 1.
Figure 7:
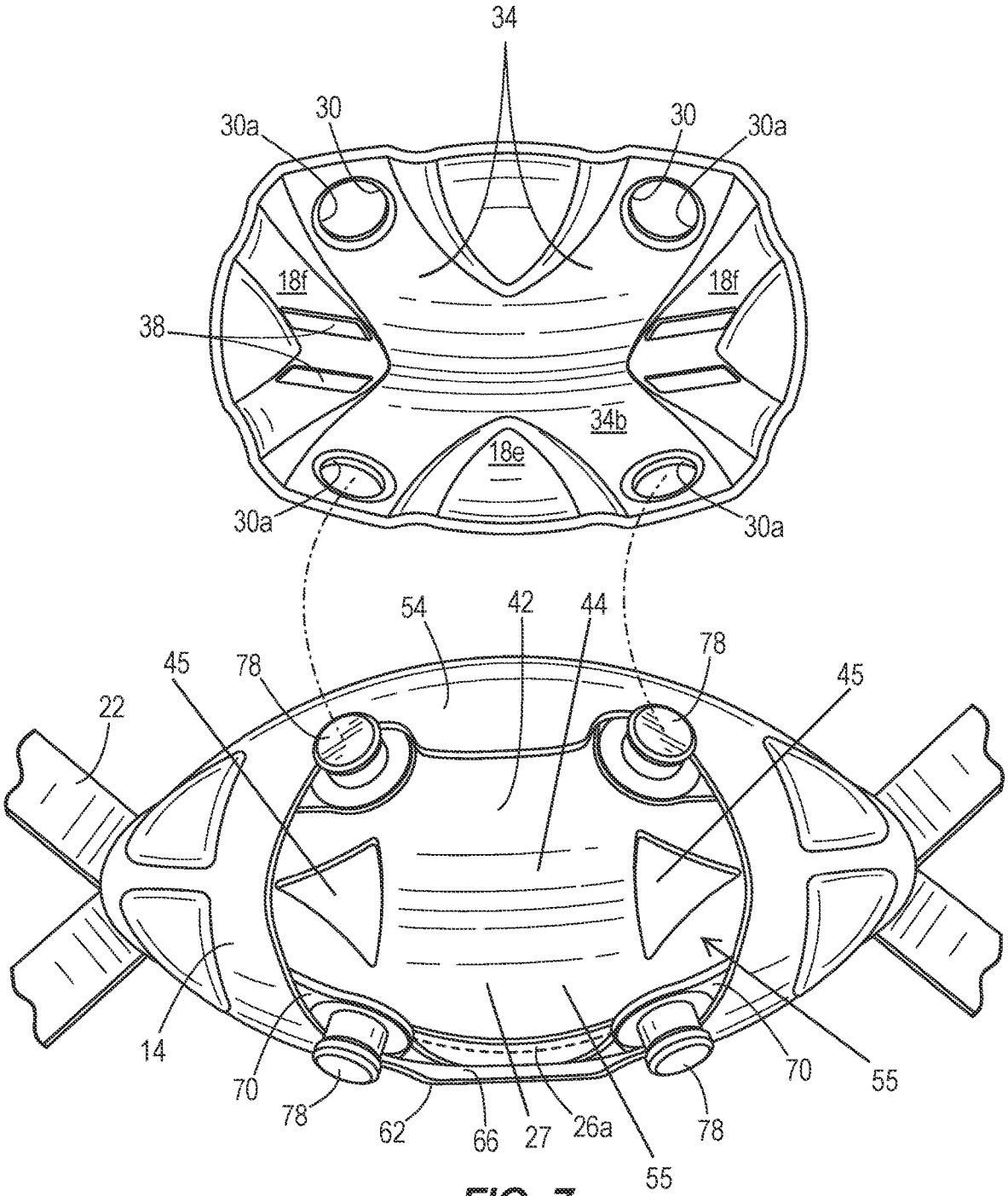
FIG. 7 is an exploded view of the chinstrap assembly of FIG. 1 showing an outer protective member removed.
Figure 8:
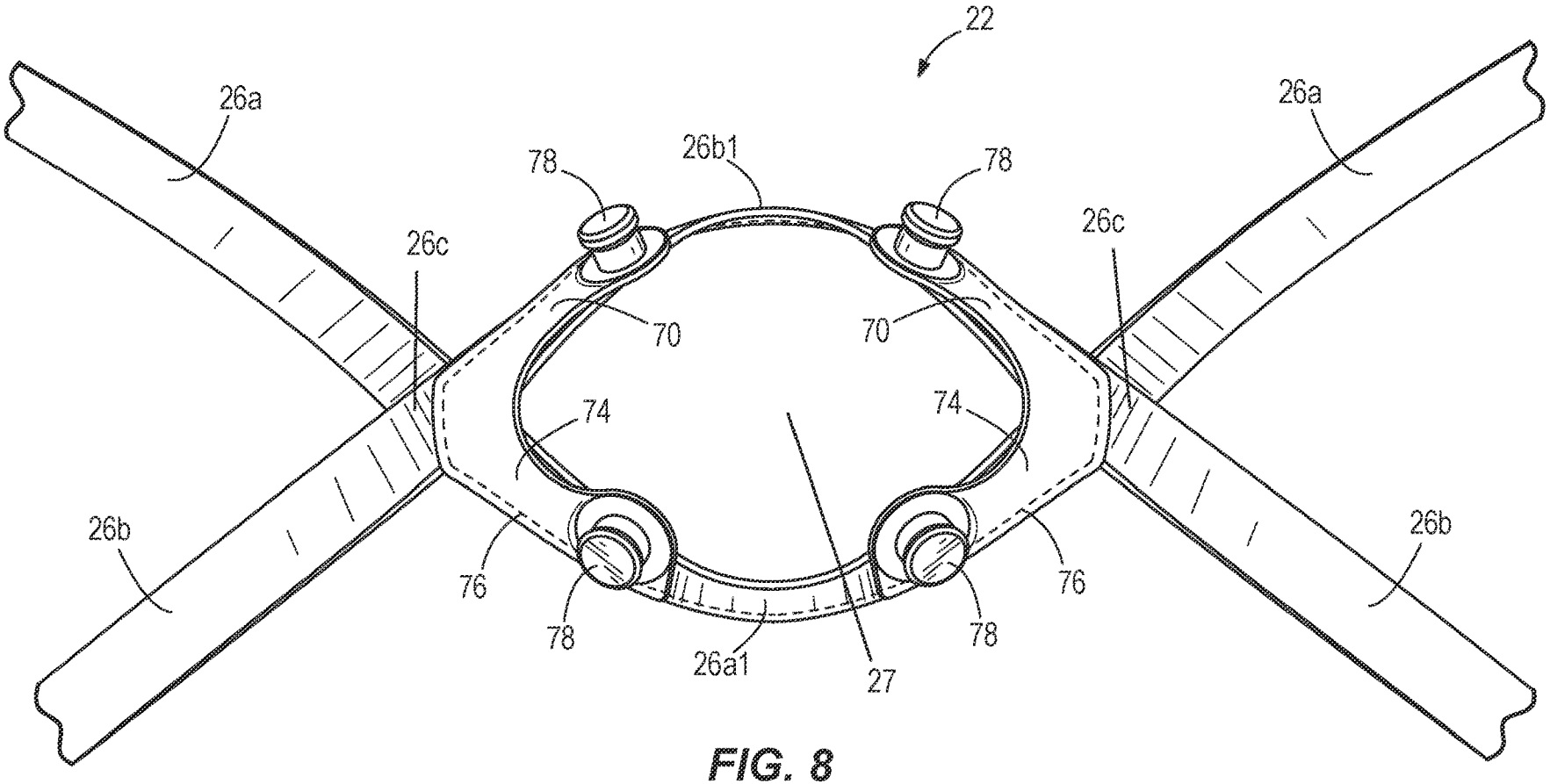
FIG. 8 is a front view of a strap assembly of the chinstrap assembly of FIG. 1.
Figure 9:
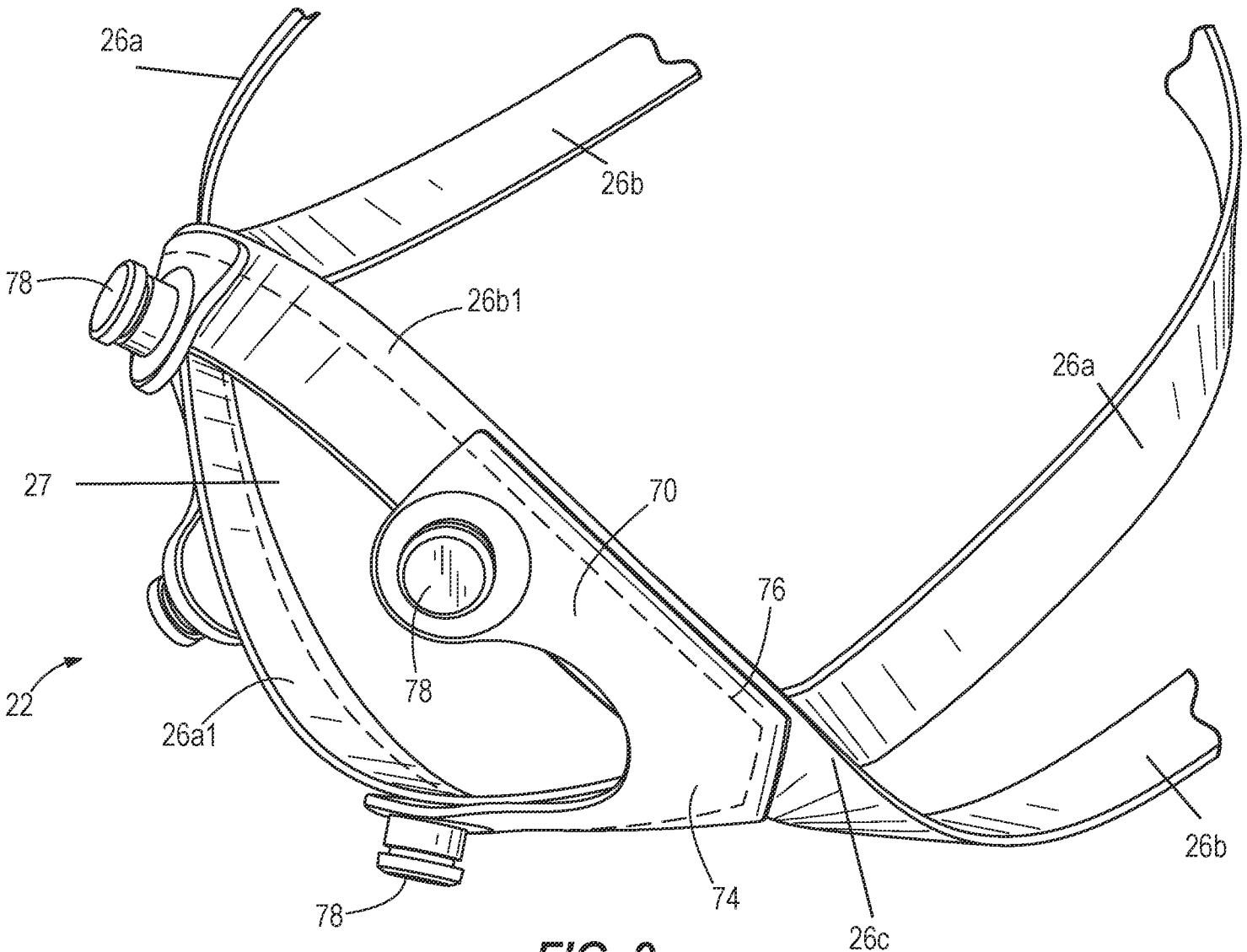
FIG. 9 is a perspective view of the strap assembly of FIG. 8.

As best shown in FIGS. 3, 6, and 7, in the illustrated embodiment, the outer protective member 18 has a substantially obround periphery (e.g., FIG. 3) and includes four attachment openings 30 located near the periphery of the outer protective member 18. A raised annular rib 31 surrounds each opening 30. Rib 34 includes a first portion and a second portion that extend in an upper "V-shaped" configuration, and a third portion and a fourth portion that extend in a lower "V-shaped" configuration, whereby the first and second portions and the third and fourth portions of the rib 34 combine to form a raised central region 17 with an X-shaped pattern. The attachment openings 30 are formed in the upper and lower regions of the rib 34, while ventilation openings 38 are provided between the raised rib 34 and the terminal ends 19*a*, 19*b*. Referring to FIG. 3, the raised rib 34 and the raised central region 17 are integrally formed as a part of the outer protective member 18 and extend between top and bottom portions 18*a* and 18*b* of the outer protective member 18. Also shown in FIG. 3, the rib 34 and the raised central region 17 are raised or elevated with respect to both an inner extent of the outer surface 18*c* and an outer extent of the outer surface 18*d* of the outer protective member 18. As such, the rib 34 include a raised outer surface 34*a* and the raised central region 17 includes a raised outer surface 17*a*. An inner angled or sloped side wall 18*e* extends between the inner extent of the outer surface 18*c* and the raised rib 34 (and the raised central region 17). An outer angled or sloped side wall 18*f* extends between the outer extent of the outer surface 18*d* and the raised rib 34 (and the raised central region 17).

As shown in FIGS. 3 and 7, a spline or intermediate structures 39 are positioned: (i) between and separating the pairs of ventilation openings 37*a*, 37*b*, and (ii) in the area of the outer extent of the outer surface 18*d* that is adjacent to the outer angled side wall 18*f* leading to the rib 34. A first pair of ventilation openings 37*a* are formed in the protective member 18 between the raised rib 34 and the first terminal end 19*a*, while a second pair of ventilation openings 37*b* are formed in the protective member 18 between the raised rib 34 and the first terminal end 19*b*. The first pair of ventilation openings 37*a* include a first vent opening 40*a* and a third vent opening 40*c*, wherein the first and third vent opening 40*a*, 40*c* have a first substantially linear edge 41*a*, a second substantially linear edge 41*b*, a third substantially linear edge 41*c*, and a fourth substantially linear edge 41*d*. The second pair of ventilation openings 37*b* include a second vent opening 40*b* and a fourth vent opening 40*d*, wherein the second and fourth vent opening 40*b*, 40*d* have a first substantially linear edge 41*a*, a second substantially linear edge 41*b*, a third substantially linear edge 41*c*, and a fourth substantially linear edge 41*d*. The first substantially linear edge 41*a* of the first vent opening 40*a* is substantially parallel with the first substantially linear edge 41*a* of the second vent opening 40*b*, while an acute angle is formed between the second substantially linear edges 41*b* of the vent openings 40*a*, 40*b*, 40*c*, 40*d* and third substantially linear edges 41*c* of the vent openings 40*a*, 40*b*, 40*c*, 40*d*.

Referring to FIG. 7 showing the underside of the protective member 18, the rib 34 are recessed or depressed with respect to adjacent inner surfaces 18*e* and 18*f* of the outer protective member 18. Also shown in FIG. 7, the spline 39 and the ventilation openings 38 are positioned in the area 18*f* that is adjacent to the recessed inner surface 34*b* formed by the rib 34. The outer protective member 18 has a curvilinear configuration and is adapted to receive an extent of the inner pad member 14 (e.g., FIG. 6). In the illustrated embodiment the outer protective member 18 is formed from an impact resistant plastic, although other generally rigid, impact resistant materials, such as composites like carbon fiber, aramid, and/or fiberglass, may also be used.

In the illustrated embodiment, the strap assembly 22 also includes means for removably coupling the outer protective member 18 to the strap assembly 22 in the form of a pair of attachment members 70 coupled to the strap members 26*a*, 26*b*. Each attachment member 70 includes a generally V-shaped web portion 74 that is joined (e.g., stitched or glued) to the strap members 26, 26*b* as at 76, a location substantially adjacent to where the strap members 26*a*, 26*b* cross one another. Each attachment member 70 also includes a pair of coupling members in the form of posts 78 positioned near or adjacent the ends of the V-shaped web portions 74. The posts 78 have an elongated configuration and are arranged for insertion into the attachment openings 30 in the outer protective member 18 to define a connected position Pc (see FIGS. 2, 3, and 6). In another embodiment, the web portion 74 is severely reduced, or even omitted from the attachment member 70 such that the posts 78 are operably connected to the strap 26*a*, 26*b*.

Figure 10:
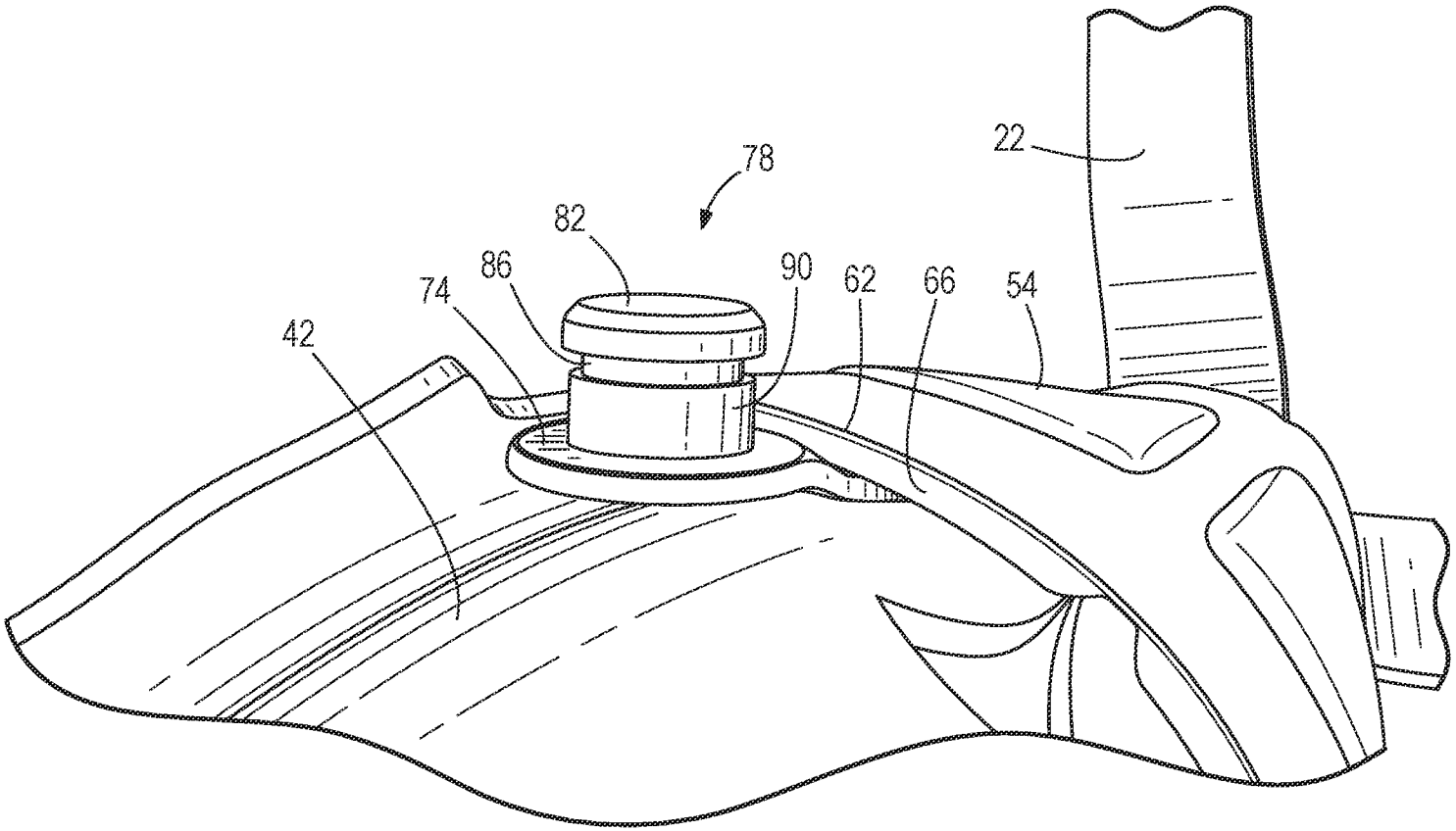
FIG. 10 is an enlarged side view of an attachment member for removably attaching the outer protective member of FIG. 7 to the chinstrap assembly.

Referring also to FIG. 10, each post 78 is generally mushroom-shaped and includes a rounded and enlarged top portion 82 adapted for insertion through a respective attachment opening 30. In the connected position Pc, the top portion 82 is substantially flush with the annular ridge 31 in the outer member 18. A circumferential groove 86 is located below the top portion 82 and receives an inner circumferential edge 30*a* of the respective attachment opening 30 in the connected position Pc. An elongated, preferably cylindrical, support portion 90 extends between the groove 86 and the web portion 74 of the attachment member 70. The support portion 90 has a height that appropriately spaces the outer protective member 18 a distance away from the strap assembly 22 such that portions of the inner pad member 22 reside between the strap assembly 22 and the outer protective member 18. In this regard, although portions of the inner pad member 14 and the outer protective member 18 may be in direct physical contact with one another, in the illustrated embodiment the outer protective member 18 is indirectly coupled to the inner pad member 14 by way of the posts 78 and the strap members 26*a*, 26*b*. This arrangement allows for relative movement between the outer protective member 18 and the inner pad member 14, as further described below.

Referring to FIGS. 7-10, the enlarged top portion 82 and groove 86 of each post 78 are cooperatively dimensioned with the attachment openings 30 in the outer protective member 18 to provide a secure snap fit between the posts 78 and the attachment openings 30 in in the connected position Pc. This reduces the likelihood of the outer protective member being inadvertently dislodged or removed from the strap assembly 22 during the course of play. Moreover, when the strap members 26*a*, 26*b* are secured, e.g., when the chinstrap assembly 10 is properly attached to a helmet by securing the snap assemblies 32 to the helmet, the posts 78 on each side of the chinstrap assembly 10 may be pulled or rotated generally outwardly (towards the helmet) such that the grooves 86 are biased or urged into further or deeper engagement with the outer portions of the circumferential edges 30*a* of the attachment openings. In some applications, the wearer's chin may function as a fulcrum such as the strap members 26*a*, 26*b* are pulled taut when the chinstrap assembly 10 is attached to the helmet, the posts 78 on each side of the chinstrap assembly 10 angularly deflect in a generally outward and upward direction (with respect to the wearer's head) such that the grooves 86 move into further or deeper engagement with the circumferential edges 30*a* of their respective attachment openings 30. These effects can reduce the likelihood of the outer protective member 18 being dislodged or removed from the strap assembly 22 during the course of play. However, when the chinstrap assembly 10 is removed the posts 78 return to un-deformed, un-deflected positions, wherein the posts 78 are essentially centered with respect to the attachment openings 30 to allow the outer protective member 18 to be removed from the strap assembly 22 by the wearer of the helmet (or the training or coaching staff), if desired.

By attaching the relatively rigid outer protective member 18 to the strap assembly 22 in discrete, spaced apart locations (e.g., at the posts 78) at the connected position Pc, relative movement is permitted between the outer protective member 18 and portions of the strap assembly 22. Even though movement of the straps 26*a*, 26*b* immediately adjacent the posts 78 is somewhat limited due to coupling of the posts 78 with the outer protective member 18, flexing and bending of the straps 26*a*, 26*b* are permitted in those portions of the strap assembly 22 that extend between and away from the posts 78. Such flexing and bending of the strap assembly 22 and the inner pad member 14 functions to accommodate, for example, anatomical variations in the chin and jaw line of the helmet wearer to provide a more customized and comfortable fit. Another structural feature that permits flexing and bending of the inner pad member 14 and the strap assembly 22 is the reduced width WI of the outer protective member 18 with respect to the width W2 of the inner pad member 14 (FIG. 6), which allows outermost portions of the inner pad member 14 to flex and bend.

Several alternative configurations of the inner pad member 14, outer protective member 18, and strap assembly 22 are possible without departing from the spirit and scope of the present invention. For example, in some embodiments, more or fewer posts 78 can be used, including two posts, a single post, three posts, and the like, in a variety of arrangements, without limitation. In some embodiments, the post or posts 78 can also or alternatively be attached to the inner pad member 14. Moreover, in some embodiments the orientation of the attachment members 70 and the openings 30 are reversed, wherein posts (or similar projections) are provided on the outer protective member 18 and suitable openings or recesses could be provided on the inner pad member 14 and/or the strap assembly 22. As noted above, some embodiments can include a different arrangement or configuration of straps 26*a*, 26*b*, and/or different configurations and structures for the inner pad member 14 and the outer protective member 18. These and other variations, whether taken alone or in combination, all fall within the spirit and scope of the present invention.

It is to be understood that the invention is not limited to the exact details of construction, operation, exact materials or embodiments shown and described, as obvious modifications and equivalents will be apparent to one skilled in the art; for example, the entire cantilever strap could be provided with a shock absorbing pad disposed upon its lower surface. Accordingly, the invention is therefore to be limited only by the scope of the appended claims. While the specific embodiments have been illustrated and described, numerous modifications come to mind without significantly departing from the spirit of the invention, and the scope of protection is only limited by the scope of the accompanying Claims.

The invention claimed is:

1. A protective sports helmet worn by a player while playing a contact sport, the protective sports helmet comprising:

a shell;

an energy attenuation assembly positioned within the shell;

a protective chin strap assembly having:

an inner pad member adapted to engage an extent of a chin of a person wearing the protective sports helmet;

an outer protective member having:

a first terminal end, a second terminal end, a raised rib that is integrally formed as part of the outer protective member, wherein said raised rib is elevated with respect to:

(i) a first outer surface of the outer protective member that is positioned between the raised rib and the first terminal end, and (ii) a second outer surface of the outer protective member that is positioned between the raised rib and the second terminal end;

a first ventilation opening formed in the first outer surface and having a first linear edge;

a second ventilation opening formed in the second outer surface and having a first linear edge;

a first angled side wall positioned between a first side of the raised rib and the first ventilation opening; and, a second angled side wall positioned between a second side of the raised rib and the second ventilation opening; and, a strap assembly having a first elongated strap member and a second elongated strap member that are: (i) coupled to the outer protective member and (ii) configured to be coupled to the shell.

2. The protective sports helmet of claim 1, wherein an extent of the first linear edges of the first and second ventilation openings are parallel.

3. The protective sports helmet of claim 2, wherein the first ventilation opening includes a second edge, and wherein the second ventilation opening includes a second edge.

4. The protective sports helmet of claim 3, wherein the first ventilation opening includes a third linear edge, and wherein an acute angle is formed between the second edge and the third linear edge of the first ventilation opening.

5. The protective sports helmet of claim 1, wherein the first ventilation opening includes a second edge and the second ventilation opening includes a second edge; and wherein the second edges of the first and second ventilation openings are positioned adjacent to the raised rib.

6. The protective sports helmet of claim 1, wherein the raised rib has an inner surface that is recessed with respect to a portion of the inner surface of the outer protective member that is positioned between the raised rib and the first terminal end.

7. The protective sports helmet of claim 6, wherein the inner pad member has a central portion and at least two ventilation openings, said central portion is positioned between the first and second ventilation openings; and wherein, in a connected position, the central portion of the inner pad member is positioned within a portion of the recess in the inner surface of the protective member.

8. The protective sports helmet of claim 1, wherein the rib includes an upper V-shaped configuration.

9. The protective sports helmet of claim 1, wherein the inner pad member includes an outermost portion that is configured to deform with respect to the outer protective member when the inner pad member is engaged with an extent of a chin of a player wearing the protective sports helmet.

10. A protective sports helmet worn by a player while playing a contact sport, the protective sports helmet comprising:

a shell;

a protective chin strap assembly having:

an inner pad member adapted to engage an extent of a chin of a player wearing the protective sports helmet;

an outer protective member having a first terminal end, a second terminal end, an inner surface, and an outer surface, the protective member having:

a raised central region having a first portion and a second portion that are integrally formed as part of the protective member, wherein the first and second portions are arranged to define an upper V-shaped configuration;

a first ventilation opening having being formed in the protective member between the raised central region and the first terminal end; and a second ventilation opening having being formed in the protective member between the raised central region and the second terminal end; and a strap assembly having a first elongated strap member and a second elongated strap member that are: (i) coupled to the protective member and (ii) configured to be coupled to the shell.

11. The protective sports helmet of claim 10, wherein the outer protective member includes both a first angled side wall positioned between a first side of the raised central region and the first ventilation opening, and a second angled side wall positioned between a second side of the raised central region and the second ventilation opening.

12. The protective sports helmet of claim 10, wherein the first ventilation opening includes an edge having a substantially linear portion and the second ventilation opening includes an edge having a substantially linear portion; and wherein the substantially linear portion of the first ventilation opening is parallel with the substantially linear portion of the second ventilation opening.

13. The protective sports helmet of claim 12, wherein the first ventilation opening includes a second edge and the second ventilation opening includes a second edge.

14. The protective sports helmet of claim 12, wherein the first ventilation opening includes a second edge and a third edge, and wherein an acute angle is formed between the second edge and the third edge of the first ventilation opening.

15. The protective sports helmet of claim 10, wherein the first ventilation opening includes a first edge and second edge, and wherein the second ventilation opening includes a first edge and second edge; and wherein the second edge of the first ventilation opening is positioned adjacent to the first portion of the raised central region, and the second edge of the second ventilation opening is positioned adjacent to the second portion of the raised central region.

16. The protective sports helmet of claim 10, wherein an extent of the inner pad member extends between the first and second portions of the raised central region; and wherein said extent of the inner pad member is configured to deform with respect to the outer protective member when the inner pad member is engaged with an extent of a chin of a player wearing the protective sports helmet.

17. The protective sports helmet of claim 10, wherein the raised central region has an inner surface that is recessed with respect to a portion of the inner surface of the outer protective member that is positioned between the raised rib and the first terminal end.

18. The protective sports helmet of claim 17, wherein the inner pad member has a central portion and at least two ventilation openings, said central portion is positioned between the first and second ventilation openings; and wherein, in a connected position, the central portion of the inner pad member is positioned within a portion of the recess in the inner surface of the protective member.

19. A protective sports helmet worn by a player while playing a contact sport, the protective sports helmet comprising:

a shell;

a protective chin strap assembly having:

(i) an inner pad member adapted to engage an extent of a chin of a person wearing the protective sports helmet, (ii) an outer protective member including:

a first ventilation opening formed in the outer protective member and having a first edge, a second edge, and a third edge, and wherein an acute angle is formed between the second edge and the third edge;

a second ventilation opening formed in the outer protective member and having a first edge, a second edge, and a third edge, and wherein an acute angle is formed between the second edge and the third edge; and wherein an extent of the first edge of the first ventilation opening is substantially parallel to an extent of the first edge of the third ventilation opening; and (iii) a strap assembly having a first elongated strap member and a second elongated strap member that are both coupled to the protective member, and configured to be coupled to the shell.

20. The protective sports helmet of claim 19, wherein the inner pad member includes an outermost portion that is configured move with respect to the outer protective member when the inner pad member is engaged with an extent of a chin of a player wearing the protective sports helmet.

21. The protective sports helmet of claim 19, further including a first angled side wall integrally formed as part of the outer protective member and positioned adjacent to the first ventilation opening, and a second angled side wall integrally formed as part of the outer protective member and positioned adjacent to the second ventilation opening.

22. The protective sports helmet of claim 21, wherein the second edge of the first ventilation opening is positioned adjacent to the first angled side wall, and the second edge of the second ventilation opening is positioned adjacent to the first angled side wall.

23. The protective sports helmet of claim 21, further including a raised rib that is integrally formed as part of the outer protective member and positioned between the first and second angled side walls.

24. The protective sports helmet of claim 23, wherein the raised rib includes an upper V-shaped configuration.

25. The protective sports helmet of claim 19, wherein the outer protective member includes a raised rib having an upper V-shaped configuration, and wherein the raised rib is positioned between the first and second ventilation openings.

26. The protective sports helmet of claim 25, wherein the raised rib has an inner surface that is recessed with respect to a portion of the inner surface of the outer protective member that is positioned between the raised rib and a first terminal end of the outer protective member; and wherein an extent of the inner pad member is configured to be positioned within an extent of the recess in the inner surface of the outer protective member.

27. The protective sports helmet of claim 19, further comprising a raised central region that is elevated with respect to: (i) a first outer surface of the outer protective member is positioned between the raised central region and the first terminal end and (ii) a second outer surface of the outer protective member is positioned between the raised central region and the second terminal end; and wherein the first ventilation opening formed in the first outer surface, and the second ventilation opening formed in the second outer surface.

28. The protective sports helmet of claim 19, wherein the first and third edges of both of the first and second ventilation openings have substantially linear extents.

29. The protective sports helmet of claim 10, wherein said raised central region is elevated with respect to: (i) a first outer surface of the outer protective member that is positioned between the raised rib and the first terminal end and (ii) a second outer surface of the outer protective member that is positioned between the raised rib and the second terminal end; and wherein the first ventilation opening formed in the first outer surface, and the second ventilation opening formed in the second outer surface.

* * * * *